US006357743B1

(12) United States Patent
Endo et al.

(10) Patent No.: US 6,357,743 B1
(45) Date of Patent: Mar. 19, 2002

(54) SHEET SET POSITION ADJUSTER MEANS FOR MOVING SHEET INDEXER

(75) Inventors: Toshio Endo; Kiichiro Noguchi; Kenji Umehara, all of Tokyo (JP)

(73) Assignee: Gradco Japan Ltd., Tokyo (JP)

( * ) Notice: Subject to any disclaimer, the term of this patent is extended or adjusted under 35 U.S.C. 154(b) by 0 days.

(21) Appl. No.: 09/629,143

(22) Filed: Jul. 31, 2000

(30) Foreign Application Priority Data

May 8, 1999 (JP) ..... 11-223072

(51) Int. Cl.[7] ..... B65H 39/10
(52) U.S. Cl. ..... 271/296; 271/300; 271/302
(58) Field of Search ..... 271/296, 300, 271/302, 200

(56) References Cited

U.S. PATENT DOCUMENTS 5,692,747 A * 12/1997 Guerrero et al. ..... 271/296
5,704,609 A * 1/1998 Mandel et al. ..... 271/290
5,865,434 A * 2/1999 Yamanaka ..... 271/296
5,884,910 A * 3/1999 Mandel ..... 271/296

* cited by examiner

*Primary Examiner*—David H. Bollinger
(74) *Attorney, Agent, or Firm*—William C. Cray

(57) ABSTRACT

A sheet or set receiving post processing machine has a plurality of vertically spaced sheet or set receiving trays extending generally horizontally at an incline, a sheet delivering infeed with vertically spaced gates, and a vertically movable sheet sender extending horizontally between each infeed location and a selected tray, wherein the sheet sender has a stapler for stapling sets of sheets thereon and wherein the sender has first and second offsetting devices for offsetting sets of sheets, whether or not stapled, and for feeding the sets to the trays in offset relation.

15 Claims, 12 Drawing Sheets

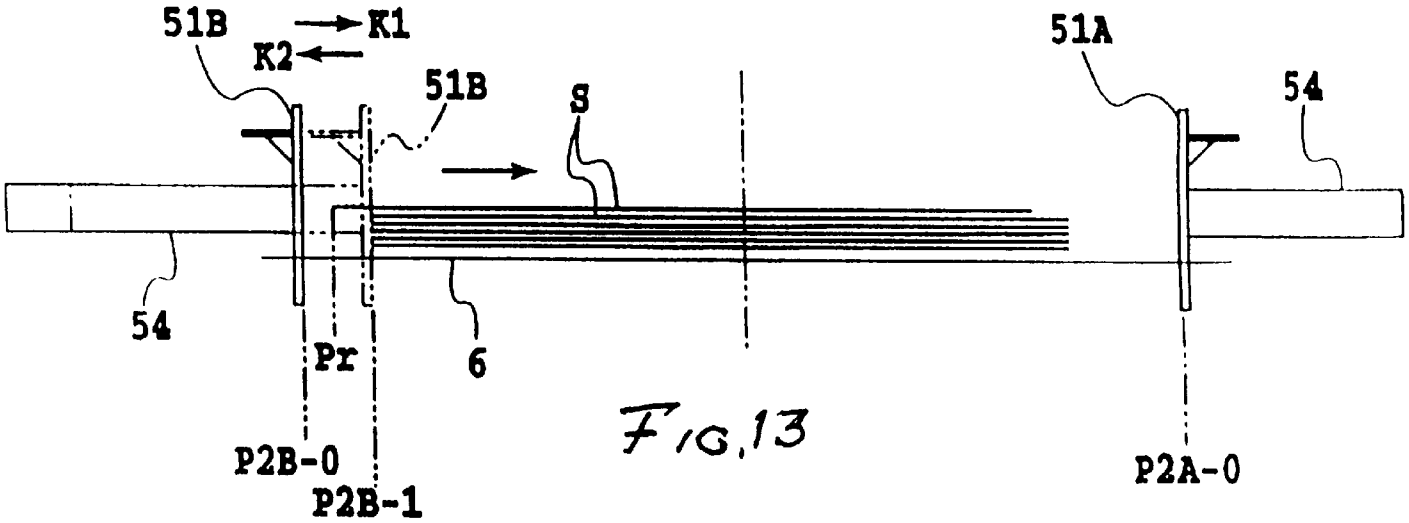
FIG. 13
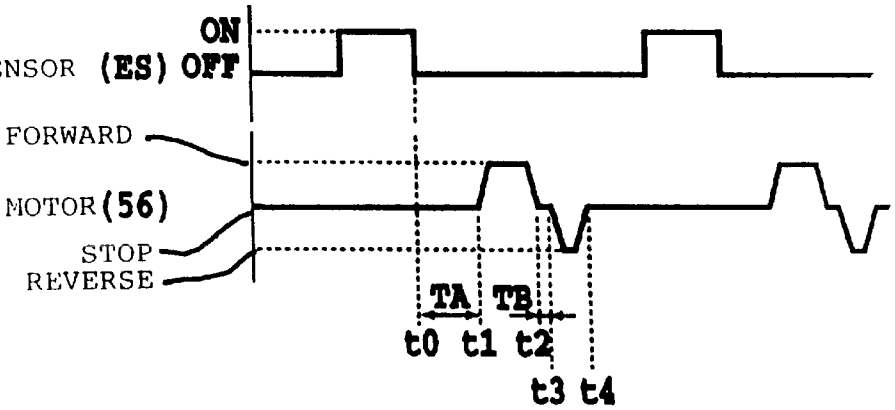
FIG. 10(a)
FIG. 10(b)

SHEET SET POSITION ADJUSTER MEANS FOR MOVING SHEET INDEXER

BACKGROUND OF THE INVENTION

In the application U.S. Ser. No. 356,656, filed Jul. 19, 1999, assigned to the same assignee as the present application, and having some of the same named inventors (the disclosure of which is hereby incorporated by reference, there is described a sheet post processing device to sort continuously transported sheets into several fixed trays. That device has features including a top infeed to an inverter, a transport path that transports sheets continuously from the inverter, several gates from which a sheet can be taken out along the path, several outlets that can eject sheets from each corresponding fixed location of receiving trays, and a sheet sending device that selectively moves between the several transport gates and the several outlets and sends the sheet transported from the transport gates to the outlets.

The present application claims priority from Japanese Patent Application S.N. 11-223072, filed on Aug. 5, 1999.

A red-lined version of this text, showing the precise changes made to this text accompanies this Amendment as Appendix 4.

SUMMARY OF THE INVENTION

The present invention provides an improvement in sheet post processing machines of the general type shown in the above mentioned application, wherein the sheets which are received on the sender are collected in sets and sent to the trays in edge aligned sets, which may be horizontally offset from one another, or sent to the trays in sets which may be offset horizontally or not.

This improvement relates to providing means for offsetting sheets and forming sets, either offset or not, and stapled or not. No means for offsetting being associated with a sender conveyor extended generally horizontally and located between the vertically spaced gates for sheets and the trays are also vertically spaced and opposite a gate for receiving the sheets or sets.

The above and other objects of the invention will be hereinafter described with greater particularity with reference to the drawings forming a part of this application.

BRIEF DESCRIPTION OF THE DRAWINGS

FIGS. 10(*a*) and 10(*b*) are timing charts to show the drive timing of the second adjustment device;

FIG. 13 is a view looking in the direction of the arrow XIII in FIG. 12(*c*)

DESCRIPTION OF THE PREFERRED EMBODIMENT

Figure 1:
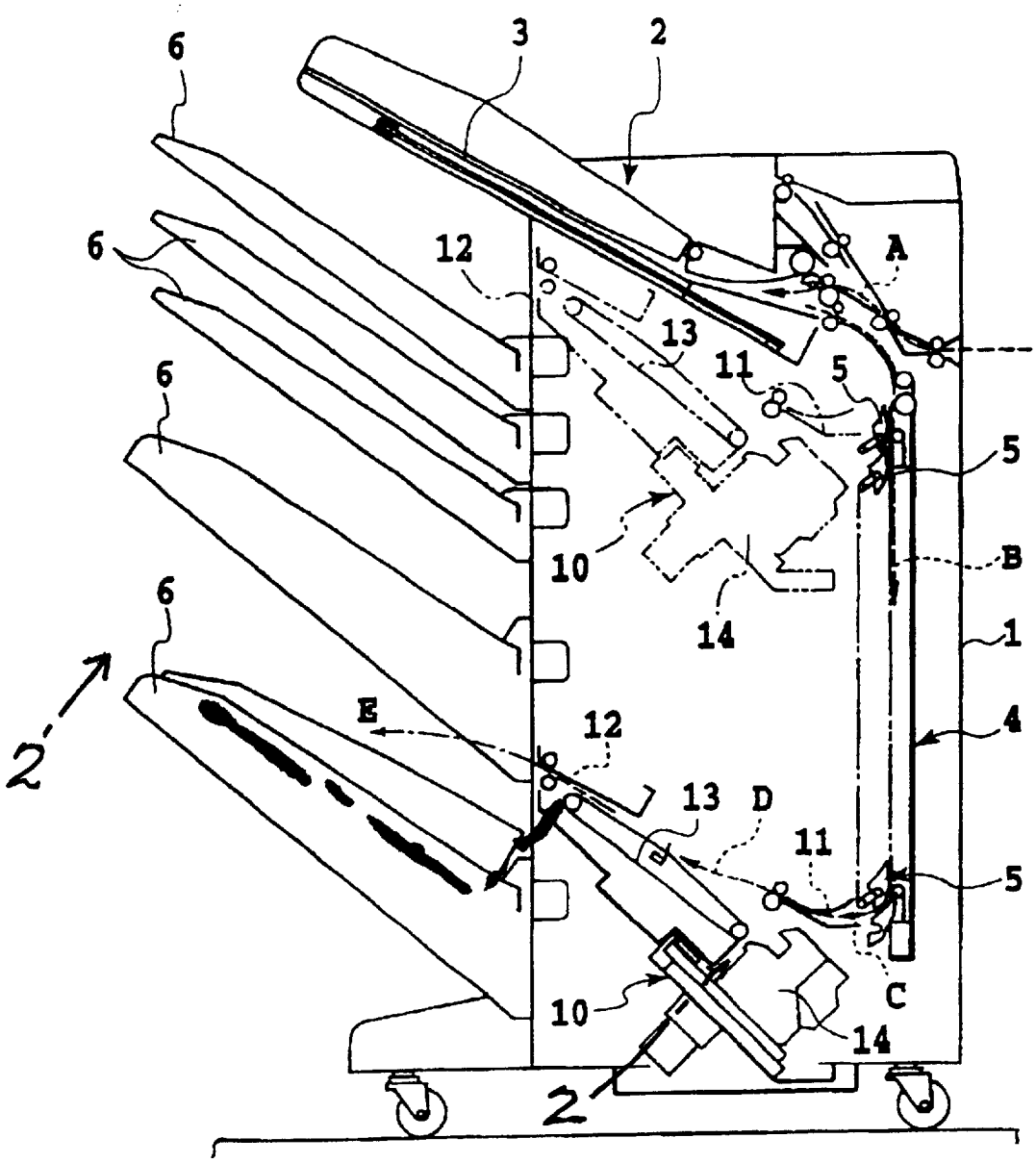
FIG. 1 is a vertical section showing a sheet post processing machine to which the invention is applicable, as more particularly illustrated and described in the above referred to prior application Ser. No. 356,656.

The sheet post processing machine 1, as disclosed more fully in pending U.S. application Ser. No. 356,656 separates the sheets whose transporting direction is reversed by the sheets reversing mechanism 2. The sheets transported from host machines such as copy machines and printers are transported to the sheet reversing mechanism 2 from the direction of the arrow A in FIG. 1. After the sheet reversing mechanism 2 reverses the transporting direction, the sheets are transported downwardly along the direction of the arrow B by the right side transporting path 4. The sheet reversing mechanism 2 reverses the transporting direction of the sheets by transporting the sheets from the direction of the arrow A onto the stage 3 and then transporting them to the transporting path 4 from the direction of the arrow B so that the trailing ends of the incoming sheets become the leading ends of the sheet moving in path 4.

The transporting path 4 has multiple sets of rollers to transport sheets in the direction of the arrow B by holding them in front and back directions. Furthermore, the transporting path 4 has multiple deflecting gates 5 that enable sheets to be removed from path 4. Also, multiple trays 6 are installed in fixed positions at the left side of the body 1. Therefore, the sheets are transported to the indexer 10 extending between a gate 5 in path 4 and a tray 6.

The indexer 10 installed inside of the body 1 as a sheet transporting device can be moved up and down. The indexer 10 is composed of the sheet transporting portion 11 and the sheet transporting portion 12. The sheet transporting portion 11 is selectively opposed to a transporting gate 5 and the sheet transporting portion 12 is selectively opposed to a tray 6 according to the vertical position of the indexer 10. The indexer 10 transports sheets onto the belt 13 from the directions of the arrows C and D through the deflecting gate 5 of the sheet transporting portion 11. The sheets transported on the belt 13 are transported onto a tray 6 at the opposite side of the sheet transporting portion 12 of belt 13 from the direction of the arrow E, by suitable feed or drive mechanism, not shown.

Therefore, the indexer 10 can transport sheets from a position in the transporting path 4 according to the vertical position of the indexer 10 and separate them into multiple trays 6. For example, when the indexer 10 moves to the lowest position as indicated by solid lines, sheets are separated into the lowest tray 6. When the indexer 10 moves to the highest position as indicated by a two-point chained line, sheets are separated into the highest tray 6. Also, the indexer 10 has a stapler 14 that can staple a group of sheets that are accumulated on the stage 13. The stapled or unstapled sheet groups are moved into tray 6 as individual sets.

Figure 2:
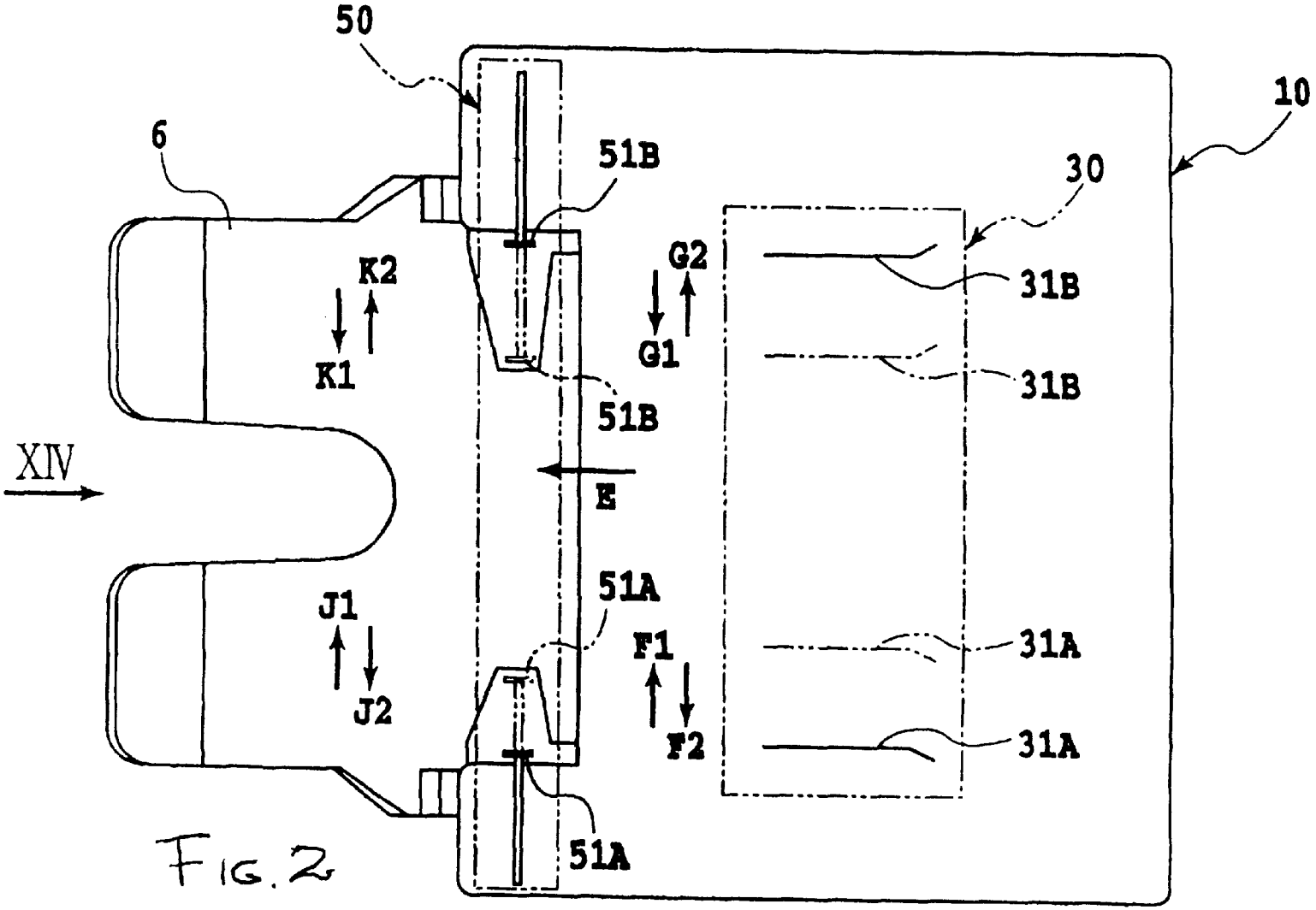
FIG. 2 is a view taken on the line 2—2 of FIG. 1 showing the sheet set sending device of the indexer and its associated means for aligning and offsetting sheets.

FIG. 2 is a top plan of the indexer 10 and the opposing tray 6. The indexer 10 has the first and second adjustment devices 30 and 50 that move up and down with the indexer 10. In the following section, the left side (for example, bottom side in FIG. 3) of the sheet transporting direction (the direction of the arrow E) is described as the left side of the sheet post processing machine of this example. The right side (for example, top side in FIG. 3) of the sheet transporting direction (the direction of arrow E) is described as the right side of the sheet post processing machine of this example. The first adjustment device 30, as mentioned later, adjusts the position of the sheets on the belt 13 in the direction of the width of the sheet by individually moving in the directions of the arrows F1, F2, G1, and G2 of the left and right first adjustment boards 31A and 31B.

The second adjustment device 50 moves up and down with the indexer 10 and is located at the side of the tray 6. The second adjustment device 50, as mentioned later, precisely adjust the positions of the sheets or sets on the tray 6 in the direction of the width of the sheet or sets by individually moving in the directions of the arrows J1, J2, K1, and K2 of the left and right second adjustment boards 51A and 51B.

Figure 3:
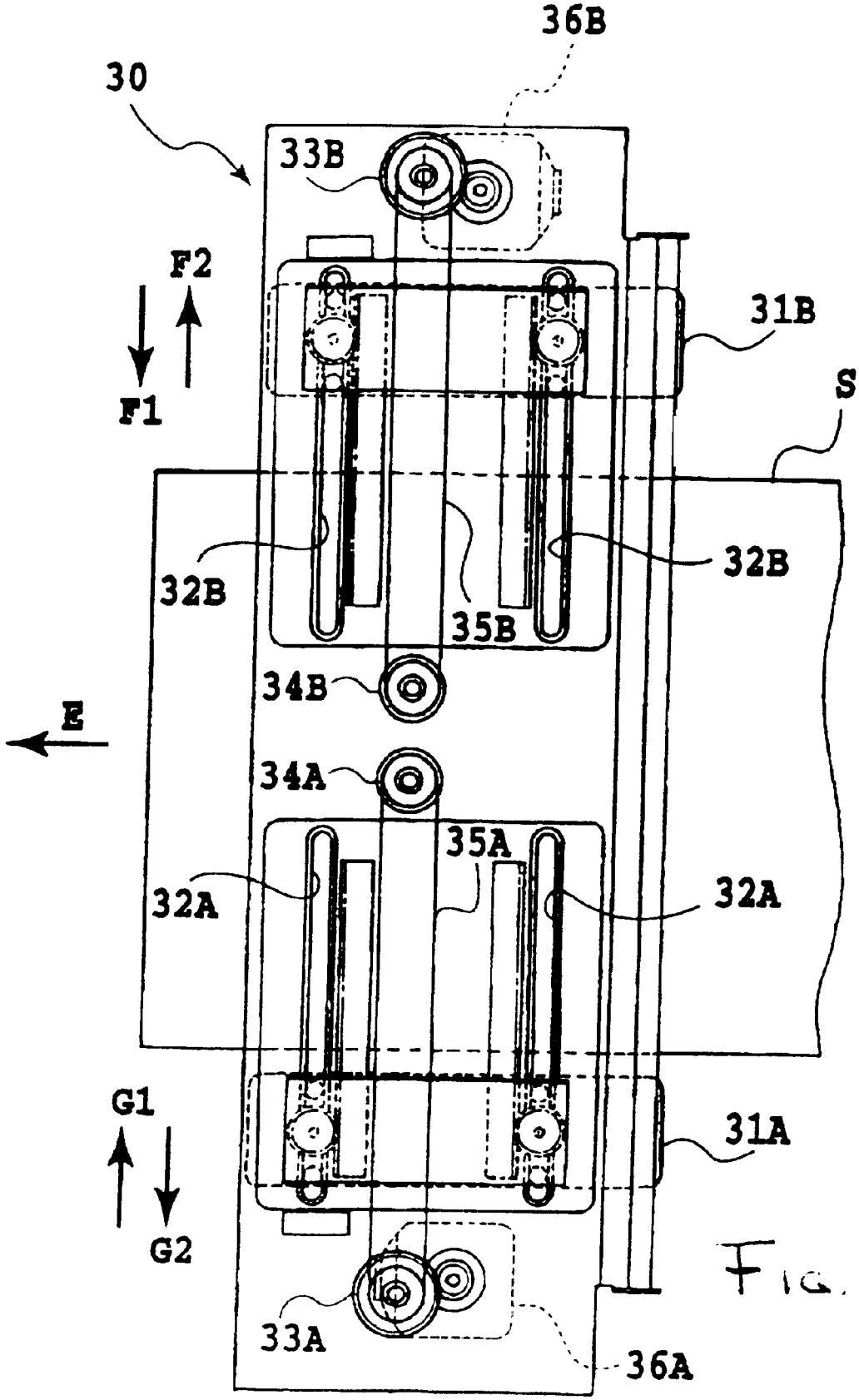
FIG. 3 is a fragmentary plan of a first sheet positioning mechanism.

FIG. 3 is a top plan for the main portion of the first adjustment device 30. The left and right first adjustment boards 31A and 31B are guided in the directions of the arrows F1, F2, G1 and G2 by guides 32A and 32B. The left first adjustment board 31A is connected to the belt 35A between the pulleys 33A and 34A. It slides in the left and right directions of the arrows F1 and F2 when the pulley 33A rotates by the left first motor 36A. Similarly, the right first adjustment board 31B is connected to the belt 35B between the pulleys 33B and 34B. It slides to left and right directions of the arrows G1 and G2 when the pulley 33B is rotated by the right first motor 36B.

Figure 4:
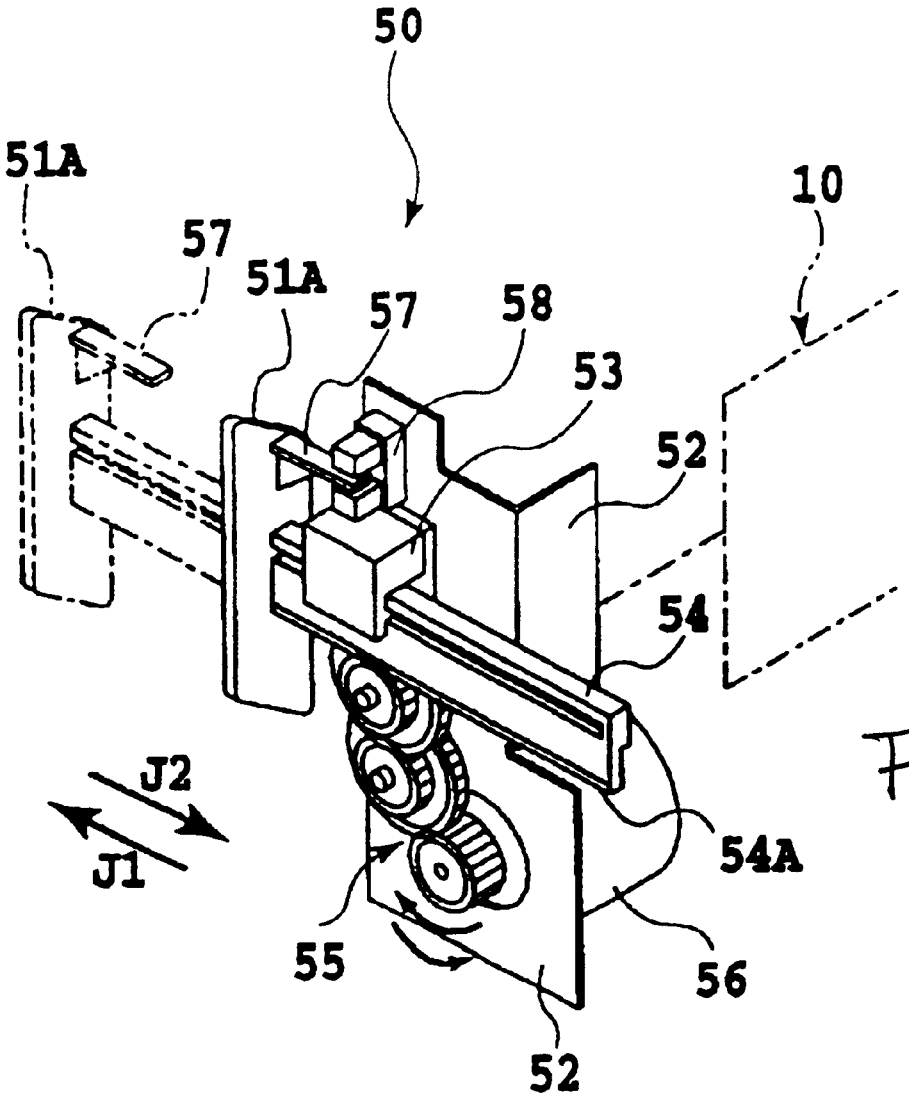
FIG. 4 is an end view in perspective of one of the second sheet positioning mechanism.

FIG. 4 is a perspective view of the drive mechanism portion of the left second adjustment board 51A of the second adjustment device 50. The rod 54 is guided in the base plate 52 in the left side of the indexer 10 by the guide block 53 and can slide in the directions of the arrows J1 and J2. The left second adjustment board 51A is installed on the front end of the rod 54. The left second motor 56 is connected to the rack portion 54A of the rod 54 through the gear row 55. The rod 54 slides in the directions of the arrows J1 and J2 with the second adjustment board 51A by forward and reverse rotations of the second motor 56. The light resistant piece 57 is installed on the adjustment board 51A. The photo sensor 58 detects the home position of the adjustment board 51A when the light resistant piece 57 shuts off the light path of the photo sensor 58. The drive mechanism portion of the right second adjustment board 51B is constructed similarly to the drive mechanism of the left second adjustment board 51A. The right second adjustment board 51B slides in the directions of the arrows K1 and K2 by forward and reverse rotations of the right second motor.

The left and right first adjustment boards 31A and 31B of the first adjustment device 30, and the left and right second adjustment boards 51A and 51B of the second adjustment device 50 are controlled inter-relatedly to slide according to an accumulation of the sheets S on the tray 6 by a control device not shown. The sheets S are accumulated on the tray 6 one by one or by a set of several sheets, or a set of sheets stapled by the stapler 14.

Movements of the accumulations of A "stack with offset" and B "stack without offset" are described below as inter-related movements of the first and second adjustment devices 30 and 50. Also, in the following description, the sheets S are accumulated one by one. The same description is applied in the cases of accumulating the sheets by several sheets or stapled group of sheets.

"Stack with Offset"

Figure 5:
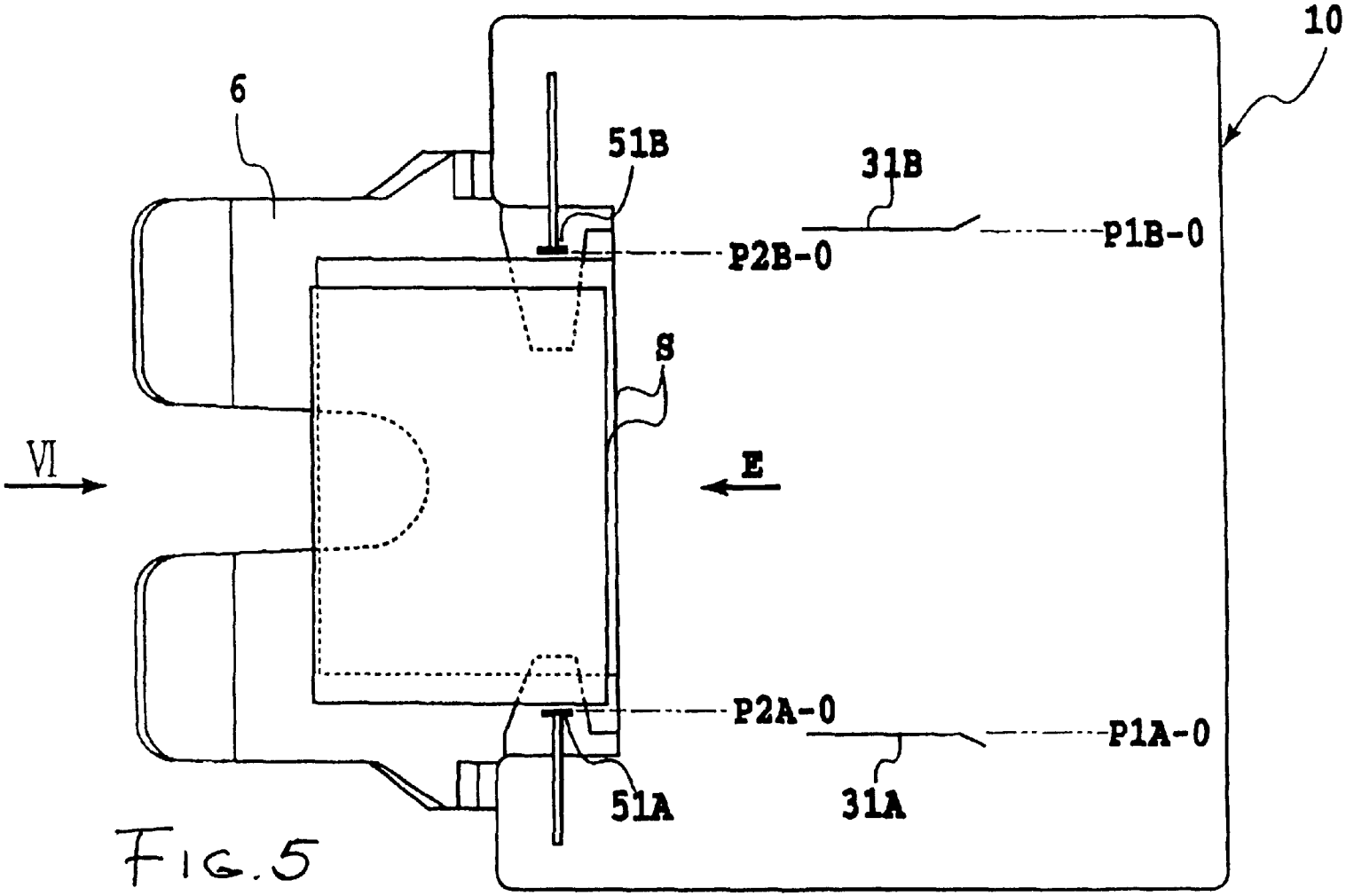
FIG. 5 is a view on the plane of the line 2—2 of FIG. 1 showing an offset sheet set on a receiving tray.
Figure 6:
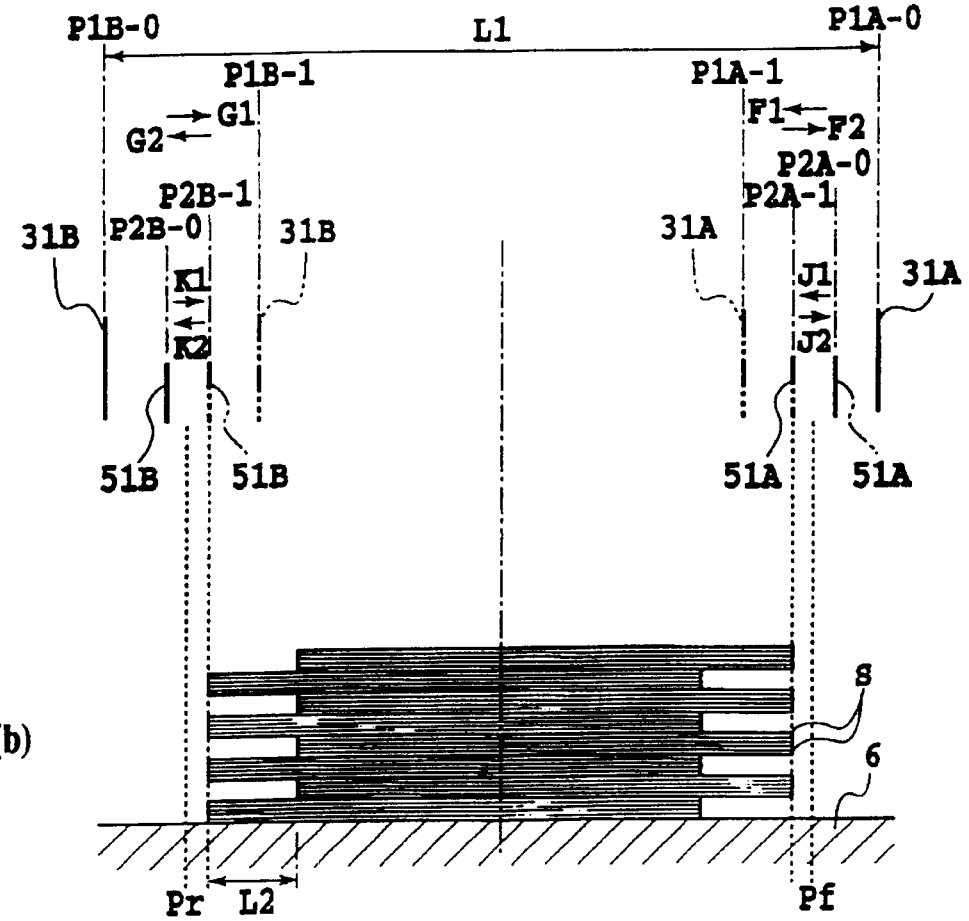
FIGS. 6(*a*) and 6(*b*) are views showing the positioning of the first and second adjustment mechanism and the locations of sheet sets on the tray.
Figure 7:
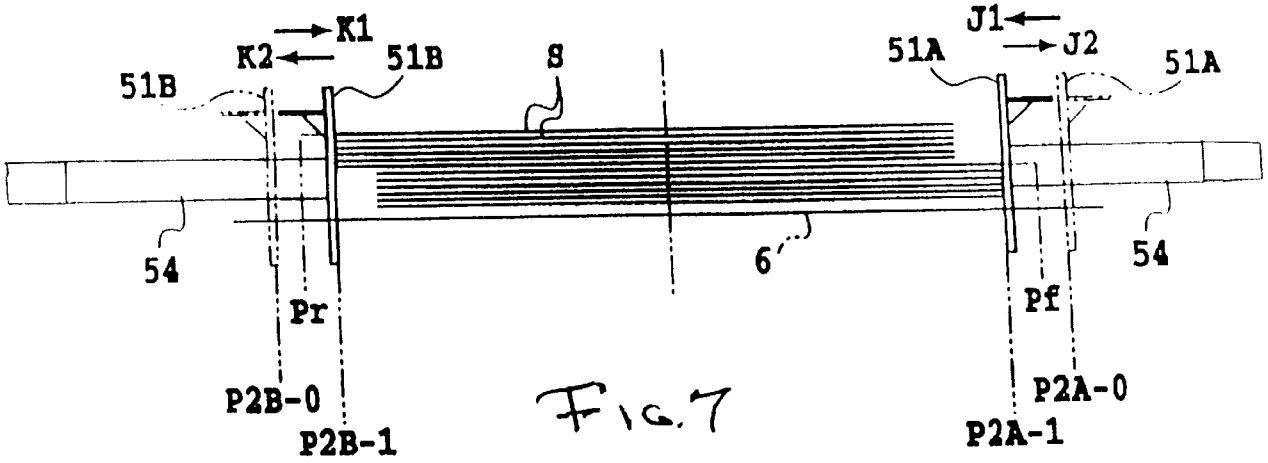
FIG. 7 is a view showing the offsetting of sheets by the second mechanism.

This "stack with offset" is form that accumulates the sheets S by offsetting the specified numbers or sets of sheets to the left and right on the tray 6 as indicated in FIG. 5. FIGS. 6(*a*) and 6(*b*) (looking in the direction of arrow VI in FIG. 5) indicate the positions of the first adjustment boards 31A and 31B, the second adjustment boards 51A and 51B, and the sheets S on the tray 6. In an accumulation form such as "stack with offset," left and right first adjustment boards 31A and 31B are moved in the directions of the arrows F1, F2, G1, and G2 between the waiting positions P1A-0 and P1B-0 and the adjustment positions P1A-1 and P1B-1 as indicated in FIG. 6(*a*). Also, in relation to these left and right first adjustment boards 31A and 31B, the left and right second adjustment boards 51A and 51B are moved in the directions of the arrows J1, J2, K1, and K2 between the waiting positions P2A-0 and P2B-0 and the adjustment positions P2A-1 and P2B-1 as indicated in FIGS. 6(*a*) and 7.

The adjustment positions P1A-1, P1B-1, P2A-1, and P2B-1 are most properly established according to the size of the sheets or sets S that are to be separated. Also, for example, the distance L1 (see FIG. 6(*a*)) between the first adjustment boards 31A and 31B and the waiting positions P1A-0 and P1B-0 is 360 mm and the amount of offset L2 (see FIG. 6(*b*)) is 20 mm.

This "stack with offset" movement is described below in A-1 "right stack" that accumulates the sheets or sets S in the front offset position at the right side of FIG. 6(*b*) and A-2 "left stack" that accumulates the sheets S in the offset position at the left side of FIG. 6(*b*).

A-1 "Right Stack"

Figure 8A:
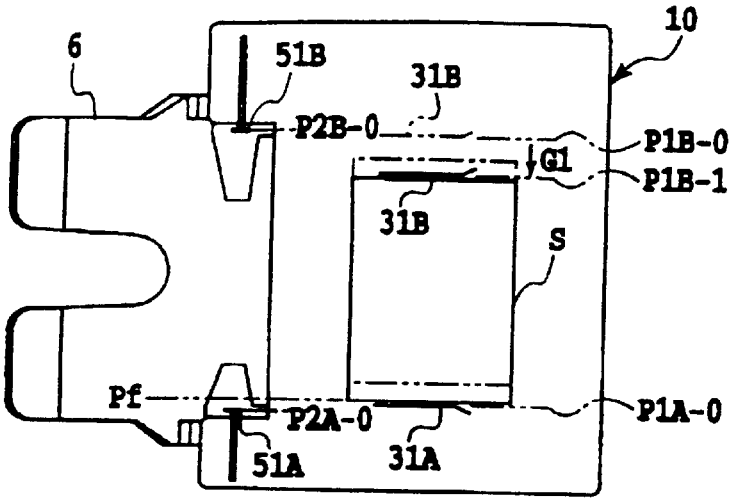
FIGS. 8(*a*), 8(*b*) and 8(*c*) are views showing accumulation of sheets on the indexer and operation of the first and second offsetting mechanisms as the set is moved on the tray.
Figure 8B:
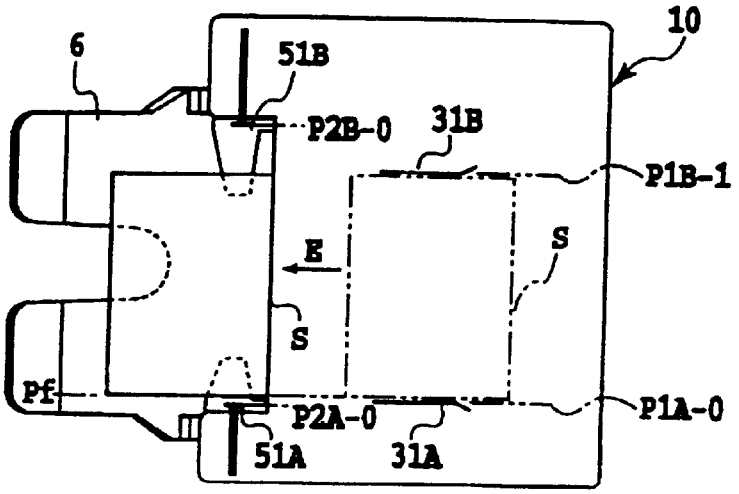
Figure 8C:
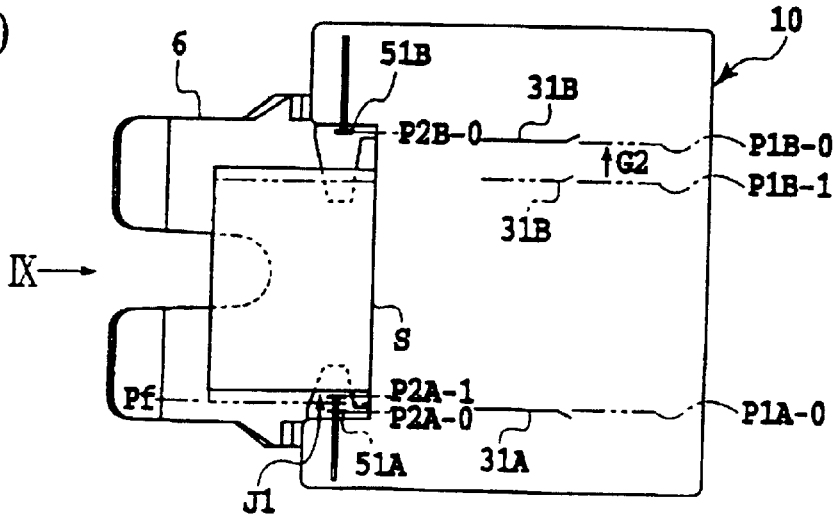

First of all, after the sheet S is transported by the belt 13 of the indexer 10 as indicated by a two-point chain line in FIG. 8(*a*), the right first adjustment board 31B is moved to the adjustment position P1B-1 as indicated by a solid line from the waiting position F1B-0 as indicated by a two-point chain line. The sheet S is offset to the position Pf toward the bottom side in FIG. 8(*a*), as indicated by a solid line. Then, the sheet S is transported onto the tray 6 as indicated in FIG. 8(*b*) by a transportation mechanism of the indexer 10. Then, as indicated in FIG. 8(*c*), the second adjustment board 51A is moved to the adjustment position P2A-1 as indicated by a solid line in FIG. 8(*a*) from the waiting position P2A-0 as indicated by a two-point chain line. The position of the sheet S is precisely adjusted toward the top side in FIG. 8(*c*), as indicated by a solid line. The first adjustment board 31B returns to the waiting position P1B-0 from the adjustment position P1B-1 as indicated by a two-point chain line.

Figure 9:
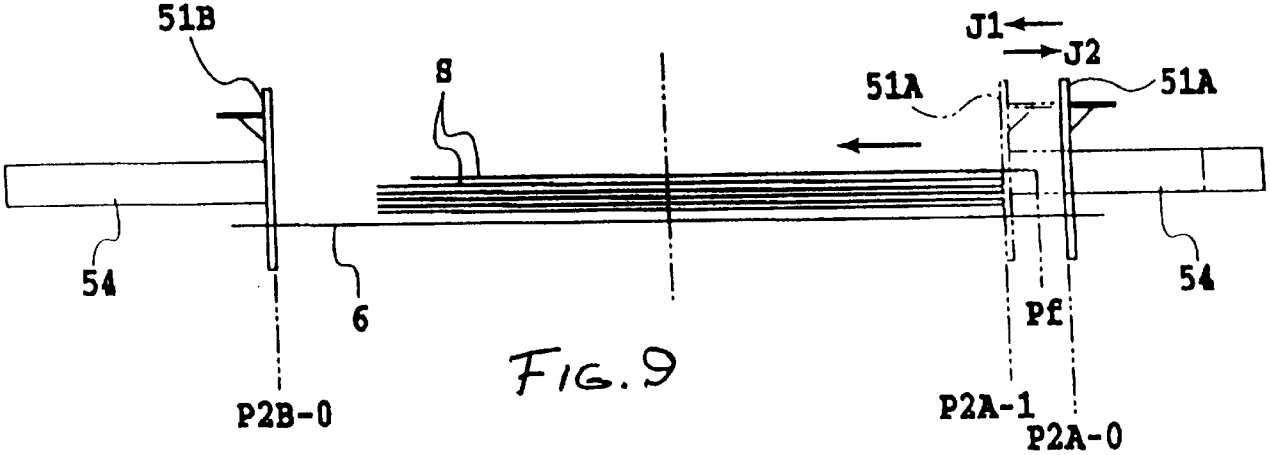
FIG. 9 is a view looking in the direction of the arrow IX of FIG. 8(*c*)

By repeating such movements, as indicated in FIG. 9, the sheets or sets S are orderly accumulated toward the tray 6. The position of the top sheet S in the FIG. 9 is precisely adjusted toward left by the second adjustment board 51A moving to the adjustment position P2A-1 as indicated by a two-point chain line from the waiting position P2A-0 as indicated by a solid line. The position of the top sheet or set S is adjusted with respect to the bottom sheet or set S that has previously been adjusted.

FIGS. 10(*a*) and 10(*b*) are timing charts to describe drive timing of the second adjustment board 51A during the "right stack" movements. The motor 56 (see FIG. 4) that drives the second adjustment board 51A, as mentioned later, forwardly or reversible drives, as indicated in FIG. 10(*b*) based on the detection timing (FIG. 10(*a*)) of the exit sensor ES that detects if the sheet or set S is transported from the stage 13 of the indexer 10.

Figure 11:
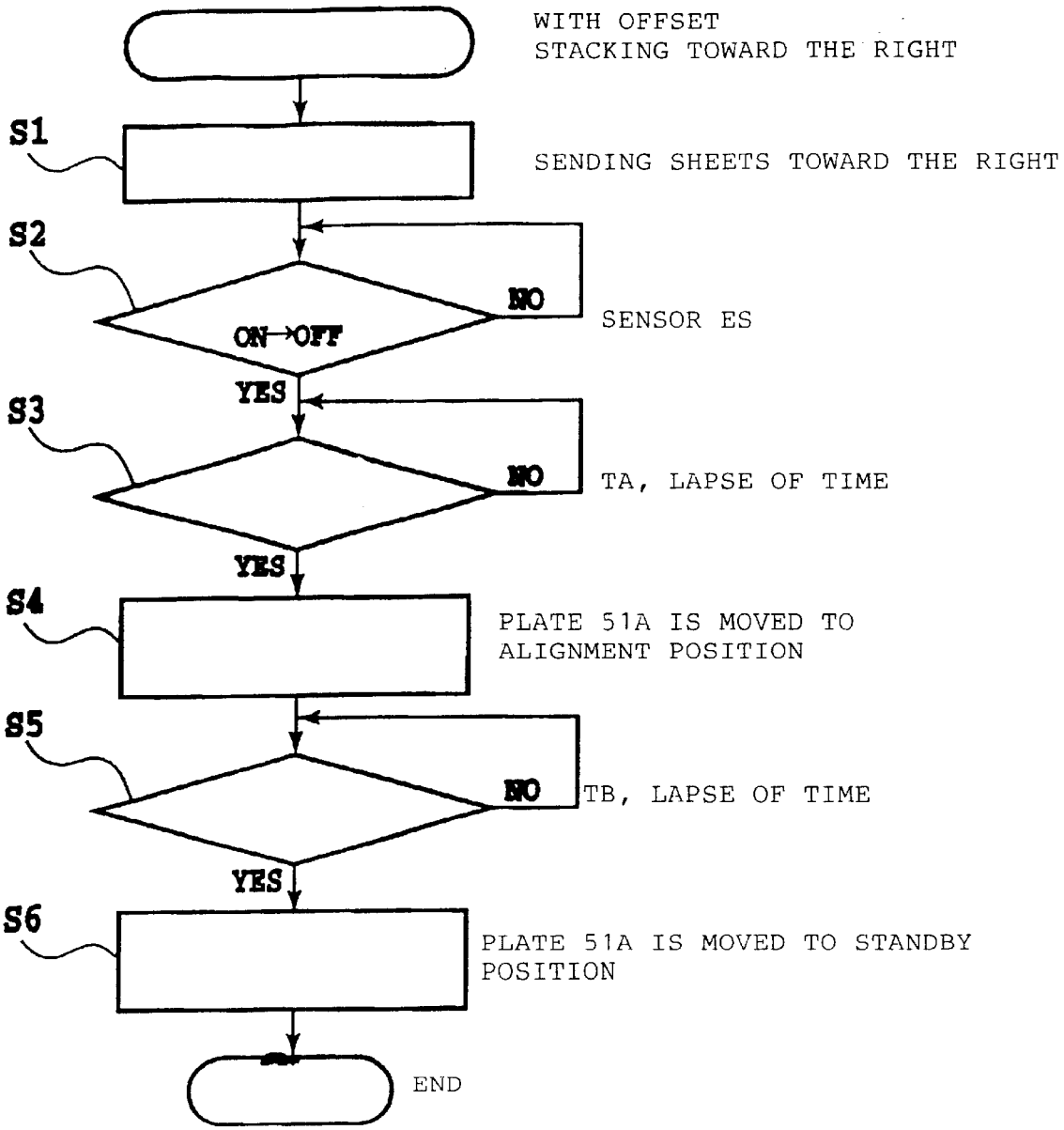
FIG. 11 is a flow chart showing the procedure for movement of the second adjustment device.

FIG. 11 is a flow chart to describe the movement procedure of the second adjustment board 51A during the "right stack" movement.

First of all, in step S1, the indexer 10 transports the sheets or set S toward the right of the tray 6 and then evaluates the detection signal of the sensor ES (Step S2). The sensor ES is turned OFF from ON when the sheet S is transported from the belt 13 of the indexer 10 (t0). And, it waits for the specified time TA (for example, 150 msec.) from that time t0 (Step S3) and when the specified time TA has passed (t1), it drives the motor 56 in a forward rotation and moves the adjustment board 51A to the adjustment position P2A-1 in the direction of the arrow J1 (Step S4). The speed of the movement of the adjustment 51A from the waiting position P2A-0 to the adjustment position P2A-1, for example, is relatively small 50 mm/sec. And, it waits the specified time TB (for example, 20 msec.) from the time t2 when the adjustment board 51A moves to the adjustment position P2A-1 (Step 5). When the specified time TB has passed (t3), is drives the motor 56 in a reverse rotation and moves the adjustment board 51A to the waiting position P2A-0 in the direction of the arrow J2 (Step S6). The speed of the movement of the adjustment board 52A from the adjustment position P2A-1 to the waiting position P2A-0 is, for example, relatively large 200 mm/sec. In FIG. 10(*b*) t4 is the timing when the adjustment board 51A returns to the waiting positions P2A-0.

"Left Stack"

Figure 12A:
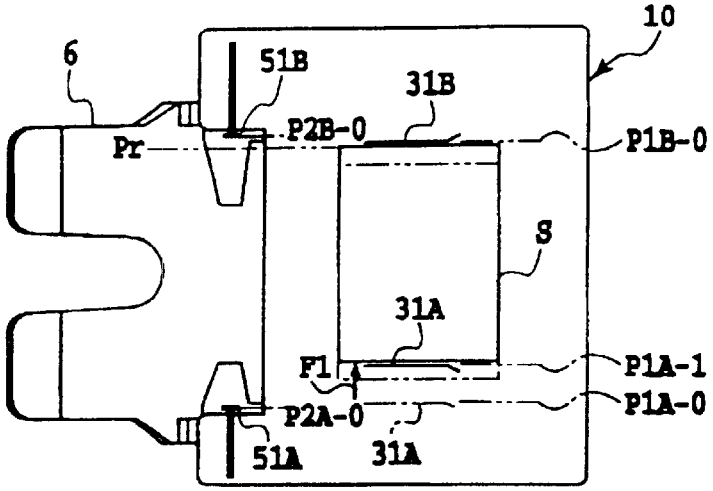
FIGS. 12(*a*), 12(*b*) and 12(*c*) show accumulation of sheets in the first adjustment device and in FIG. 12(*c*) the sheets positioned in and by the second adjustment device.
Figure 12B:
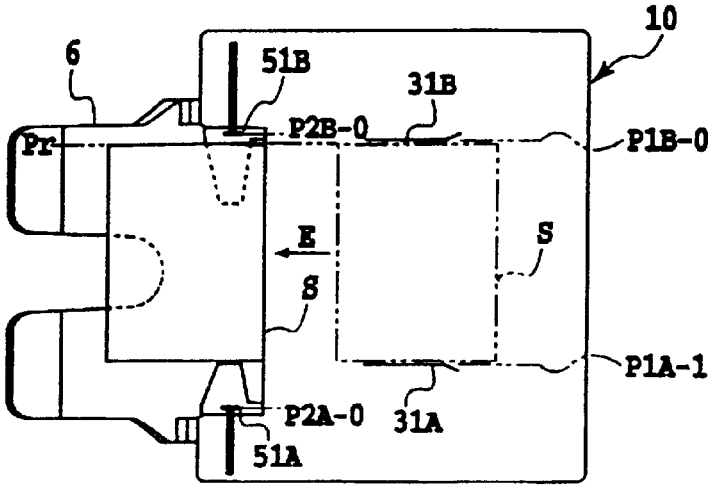
Figure 12C:
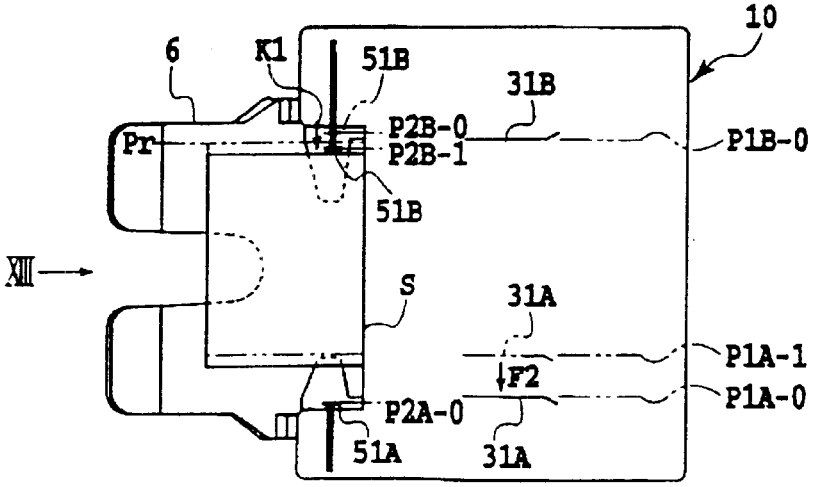

First of all, after the sheets or set S is transported to the belt 13 of the indexer 10 as indicated by a two-point chain line in FIG. 12(*a*), the first adjustment board 31A is moved to the adjustment position P1A-1 as indicated by a solid line from the waiting position P1A-0 as indicated by a two-point chain line. The first adjustment board 31A offsets the sheets or set S Pr (top side) as indicated by a solid line. Then, the transportation mechanism of the indexer 10, not shown, transports the sheet S onto the tray 6 as indicated in FIG. 12(*b*). Then, as indicated in FIG. 12(*c*), the second adjustment board 51B moves to the adjustment position P2B-1 as indicated by a solid line from the waiting position P2B-0 as indicated by a two-point chain line and precisely adjusts the position of the sheets or set S as indicated by a solid line. The left first adjustment board 31A returns to the waiting position P1A-0 form the adjustment position P1A-1 as indicated by a two-point chain line in FIG. 12(*c*).

By repeating these movements, as indicated in FIG. 13, the sheets or sets S are orderly accumulated toward the right of the tray 6. The position of the top sheets or set S is precisely adjusted toward the second adjustment board 51B moving to the adjustment position P2B-1 as indicated by a two-point chain line from the waiting position P2B-0 as indicated by a solid line. The top sheet S is adjusted along with the bottom sheet S that has previously been precisely adjusted.

The drive timing of the right second adjustment board 51B is the same as the drive timing of the second adjustment board 51A in the aforementioned FIGS. 10(*a*) and 10(*b*). Also, the movement procedure of the right second adjustment board 51B is the same as the movement procedure of the second adjustment board 51A in the aforementioned FIG. 11.

B "Stack without Offset"

Figures 14A, 14B:
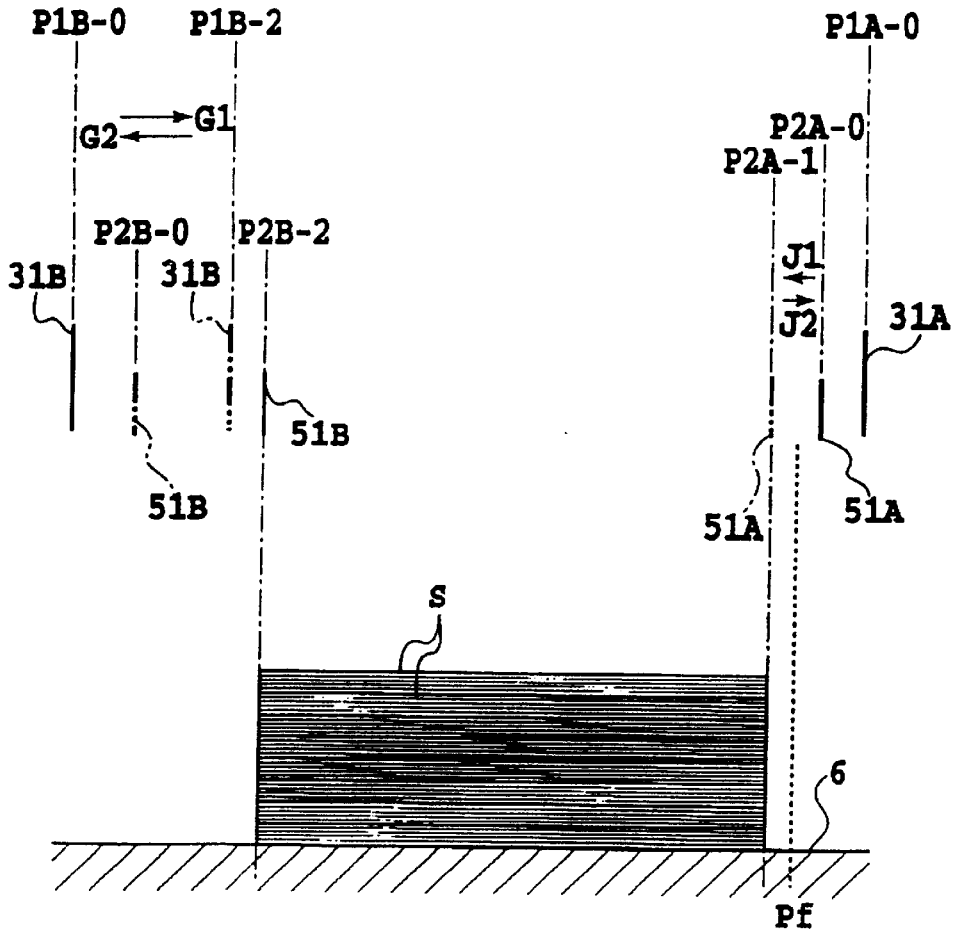
FIGS. 14(*a*) and 14(*b*) show the position of the first and second adjustment devices and show sheets accumulated on the tray without offset.

This "stack without offset" is a form that continuously accumulates the sheet S onto the tray 6 without offsetting them as indicated in FIGS. 14(*a*) and 14(*b*). In this example, the first adjustment board 31B and the second adjustment board 51A move to accumulates the sheet S toward the right side of FIG. 14(*b*). However, the second adjustment board 51B moves to the adjustment position P2B-2 that adjusts the sheets or set S on the tray 6. Also, the left first adjustment board 31A is still waiting in the waiting position P1A-0. Similarly, the sheet S can be accumulated toward the left side of FIG. 14(*b*).

As described above, this invention uses a sheet or set transporting device that selectively moves to positions opposite multiple tray. First of all, it adjusts the position of the sheets in the direction of the width of the sheet by the first adjustment device to be transported onto a tray. After the adjusted sheets are transported onto a tray, the second adjustment device precisely adjusts the position of the sheet in the direction of the width of the sheet by the second adjustment device to accurately adjust and separate them.

Furthermore, the second adjustment device moves with the transporting device to precisely adjusts the position of the sheet on multiple tray.

What is claimed is:

1. A sheet transporting indexing device adapted to be selectively moved vertically between a gate of a vertically extended infeed from a sheet and set producing machine, comprising a vertically spaced horizontally extended tray for receiving sheets and sets supplied to said sheet transporting device from the gate, said sheet transporting device including a horizontally extending and shiftable belt, first sheet position adjustment means for selectively positioning the sheet supplied to said belt from the gate, second adjustment means for selectively positioning the sheet on said tray upon movement of said belt to feed the sheet to said tray.

2. A sheet transporting device as defined in claim 1, wherein said first adjustment means and said second adjustment means each include a pair of opposed sheet position adjusting boards relatively horizontally movable with respect to one another, and means for selectively moving saiy boards horizontally.

3. A sheet transporting device as defined in claim 2, wherein said boards of said first adjustment means are movable horizontally adjacent to said gate.

4. A sheet transporting device as defined in claim 2, wherein said boards of said second adjustment means are movable horizontally adjacent to said tray.

5. A sheet transporting device as defined in claim 2, wherein said boards of said first and said second adjustment means are operable by motor means selectively operable to move said boards horizontally independently of one another.

6. A sheet transporting indexing device adapted to be selectively moved vertically between a gate of a vertically extended infeed from a sheet and set producing machine, comprising a vertically spaced horizontally extended tray for receiving sheets and sets supplied to said sheet transporting device from the gate, said sheet transporting device indexing device including a horizontally extending and shiftable belt, a first sheet position adjustment mechanism adapted to selectively positioning the sheet supplied to said belt from the gate, and a second adjustment mechanism adapted to selectively position the sheet on said tray upon movement of said belt to feed the sheet to said tray.

7. A sheet transporting device as defined in claim 6, wherein said first adjustment mechanism and said second adjustment mechanism each include a pair of opposed sheet position adjusting boards relatively horizontally movable with respect to one another, and a board moving mechanism adapted to selectively move said boards horizontally.

8. A sheet transporting device as defined in claim 7, wherein said boards of said first adjustment means are movable horizontally adjacent to said gate.

9. A sheet transporting device as defined in claim 7, wherein said boards of said second adjustment mechanism are movable horizontally adjacent to said tray.

10. A sheet transporting device as defined in claim 7, wherein said boards of said first and said second adjustment mechanism are operated by a motorized mechanism adapted to selectively move said boards horizontally independently of one another.

11. A method of transporting and arranging sheets of sets of sheets on a sheet transporting indexing device adapted to be selectively moved vertically between a gate of a vertically extended infeed from a sheet and set producing machine, comprising positioning a vertically spaced horizontally extended tray for receiving sheets and sets supplied to said sheet transporting indexing device from the gate, said sheet transporting indexing device including a horizontally extending and shiftable belt, selectively positioning the sheets supplied to said belt from the gate, and selectively positioning the sheets on said tray upon movement of said belt to feed the sheets to said tray.

12. The method of claim 11, wherein said first selective positioning step and the second selective positioning step mechanism each include utilizing a pair of opposed sheet position adjusting boards relatively horizontally movable with respect to one another, and selectively moving said boards horizontally.

13. The method of claim 12, wherein said boards utilized in the first positioning step are movable horizontally adjacent to said gate.

14. The method of claim 12, wherein said boards utilized in the second positioning step are movable horizontally adjacent to said tray.

15. The method of claim 12, wherein said boards utilized in said first and said second positioning steps are operated by a motorized mechanism to selectively move said boards horizontally independently of one another.

* * * * *